US008034157B2

(12) United States Patent
Bogner et al.

(10) Patent No.: US 8,034,157 B2
(45) Date of Patent: Oct. 11, 2011

(54) METHOD AND DEVICE FOR CHARGING FEEDSTOCK

(75) Inventors: Hans Werner Bogner, Linz (AT); Guenther Brunnbauer, Wallern (AT); Franz Lasinger, Walding (AT); Bernhard Schuerz, Linz (AT)

(73) Assignee: Siemens Vai Metals Technologies GmbH (AT)

( * ) Notice: Subject to any disclaimer, the term of this patent is extended or adjusted under 35 U.S.C. 154(b) by 196 days.

(21) Appl. No.: 12/091,266

(22) PCT Filed: Oct. 5, 2006

(86) PCT No.: PCT/EP2006/009632

§ 371 (c)(1),
(2), (4) Date: Jul. 9, 2008

(87) PCT Pub. No.: WO2007/048490

PCT Pub. Date: May 3, 2007

(65) Prior Publication Data

US 2008/0282841 A1 Nov. 20, 2008

(30) Foreign Application Priority Data

Oct. 24, 2005 (AT) ..... A 1735/2005

(51) Int. Cl.
*C21B 5/00* (2006.01)
*C21B 7/08* (2006.01)

(52) U.S. Cl. ..... 75/383; 75/414; 75/469; 414/150; 414/151; 266/199

(58) Field of Classification Search ..... 414/150, 414/151; 75/414, 469, 380
See application file for complete search history.

(56) References Cited

U.S. PATENT DOCUMENTS

| | | | | |
|---|---|---|---|---|
| 3,693,812 | A * | 9/1972 | Mahr et al. | 414/148 |
| 3,929,240 | A | 12/1975 | Legille et al. | |
| 4,066,443 | A * | 1/1978 | Currier | 75/470 |
| 4,322,197 | A * | 3/1982 | Mahr et al. | 414/206 |
| 4,575,790 | A * | 3/1986 | Legille et al. | 700/1 |
| 4,714,396 | A | 12/1987 | Bernard et al. | 414/161 |
| 4,728,240 | A * | 3/1988 | Mahr et al. | 414/21 |
| 4,776,884 | A * | 10/1988 | Chen et al. | 75/469 |

(Continued)

FOREIGN PATENT DOCUMENTS

DE 2 320 532 1/1974

(Continued)

OTHER PUBLICATIONS

Machine translation of JP 11140517 A published May 1999.*

(Continued)

*Primary Examiner* — Roy King
*Assistant Examiner* — Tima M McGuthry Bank
(74) *Attorney, Agent, or Firm* — Ostrolenk Faber LLP

(57) ABSTRACT

A method and a device for charging feedstock, in particular coke or ore, and optionally separated fines of feedstock, for processing in a metallurgical vessel, to produce metal or primary metal products. The device includes a charging mechanism, which has a conveying device and at least one feeding device for supplying to the charging mechanism. The conveying device has an outlet opening which can be guided along an inwardly directed spiral during the charging into the vessel, to set a predefined coverage in the vessel. Charged materials can thereby be positioned precisely in the vessel, and it is possible for fines to be uniformly distributed in the circumferential region.

22 Claims, 4 Drawing Sheets

U.S. PATENT DOCUMENTS

| | | | | |
|---|---|---|---|---|
| 4,806,056 | A * | 2/1989 | Rouse et al. | 414/160 |
| 4,963,186 | A * | 10/1990 | Shimizu et al. | 75/378 |
| 5,271,609 | A | 12/1993 | Kepplinger et al. | |
| 5,694,302 | A | 12/1997 | Faulk | |
| 6,580,744 | B1 | 6/2003 | Irnich | |
| 6,981,831 | B2 | 1/2006 | Lonardi et al. | |
| 7,311,486 | B2 * | 12/2007 | Gorza et al. | 414/301 |
| 2005/0168198 | A1 | 8/2005 | Maksimovic et al. | |

FOREIGN PATENT DOCUMENTS

| | | | |
|---|---|---|---|
| DE | 199 29 180 | A1 | 1/2001 |
| EP | 0 196 487 | | 10/1986 |
| EP | 0 204 935 | B1 | 3/1989 |
| EP | 0 516 613 | A1 | 12/1992 |
| EP | 1 325 157 | B1 | 4/2004 |
| GB | 1 403 687 | | 8/1975 |
| GB | 1 429 502 | | 3/1976 |
| GB | 2 038 463 | A | 7/1980 |
| JP | 55-028308 | | 2/1980 |
| JP | 58-123808 | | 7/1983 |
| JP | 60-13004 | | 1/1985 |
| JP | 61-227108 | | 10/1986 |
| JP | 63-140006 | | 6/1988 |
| JP | 1-119612 | | 5/1989 |
| JP | 06145731 | A * | 5/1994 |
| JP | 7-268413 | | 10/1995 |
| JP | 11140517 | A * | 5/1999 |
| WO | WO 02/24962 | A1 | 3/2002 |

OTHER PUBLICATIONS

Machine translation of JP 06-145731 published May 1994.*

International Search Report dated Apr. 26, 2007 issued in corresponding PCT Application No. PCT/EP2006/009632.

Notice of Opposition mailed Apr. 29, 2010 in corresponding European Patent No. EP 1 941 066.

G. Heynert and E. Legille, "Bell-less top for high top pressure furnaces," Developments in Ironmakin,g Practice, proceedings of a conference organized by The Iron and Steel Institute at the Cafe Royal, London, Nov. 22-23, 1972, published 1973, pp. 109-135.

* cited by examiner

METHOD AND DEVICE FOR CHARGING FEEDSTOCK

CROSS REFERENCE TO RELATED APPLICATION

The present application is a 35 U.S.C. §§371 national phase conversion of PCT/EP2006/009632, filed 5 Oct. 2006, which claims priority of Austrian Application No. A1735/05, filed 24 Oct. 2005. The PCT International Application was published in the German language.

BACKGROUND OF THE INVENTION

The invention relates to a method for charging feedstock, in particular coke or ore, and optionally separated fines of feedstock, for processing in a metallurgical vessel, in particular a blast furnace, to produce metal or primary metal products, in particular steel or primary steel products, comprising a charging mechanism, which has a conveying means and at least one feeding device for supplying to the charging mechanism.

When charging feedstock into metallurgical vessels in which the feedstock is processed, the precise quantity and the position in the vessel of the materials introduced are important.

The prior art discloses charging methods and devices, it being customary to distribute the feedstock in the metallurgical vessel in an annular form. For this purpose, predefined setting positions of a loading device are successively adopted and consequently the feedstock is introduced in a number of circular rings. One particular disadvantage of this is that it is not possible to achieve a very homogeneous distribution of the feedstock.

SUMMARY OF THE INVENTION

On the basis of the prior art, it is an object of the invention to provide a method and a device which make more uniform and precise loading possible.

The object according to the invention is achieved by means of the charging method and the charging device according to the invention.

The method according to the invention envisages charging of the feedstock, and optionally fines, into a metallurgical vessel, with the charging being performed in a spiral manner to set a specific distribution of the charged materials, the spiral being formed from the outside inward. The conveying means is guided along a spiral, so that the charged materials are also deposited along a spiral. On account of the stepless guidance of the conveying means, there is a steady change in the radial position while the position in the circumferential direction changes. The change in the radial position takes place continuously and constantly while the position in the circumferential direction is changed. On account of these measures, predefined coverages in the vessel with the charged materials can be achieved. In comparison with conventional methods, it is possible to set more complex coverages or to charge even more uniformly. The conveying means is turned steplessly about one axis and at the same time inclined about a further axis. This biaxial guidance with simultaneous changing of the inclination allows charging over the entire surface area of the vessel into which charging is performed. An important factor here is the stepless and simultaneous positioning, so that complete charging over the entire inner cross-sectional area of the metallurgical vessel is possible.

The control of the charging mechanism and the charging are performed in accordance with a predefined pouring plan.

The charging in accordance with a pouring plan ensures advantageous operation of the method in the metallurgical vessel.

According to a further particular refinement of the method according to the invention, the pouring plan is set on the basis of a measured actual temperature distribution and a set temperature distribution of the solids located in the vessel. On account of the much more precise charging, a target temperature distribution in the vessel can be set even better. The charging can be used for example to influence the gas distribution characteristics in the burden of a blast furnace, the gas distribution characteristics manifesting themselves as the temperature distribution in the vessel. On account of the spiral charging, deviations from a set temperature distribution can be avoided even better.

According to an advantageous refinement of the method according to the invention, the supply of the feedstock, and optionally fines, from the feeding device takes place with the quantity being regulated. During the charging, material is introduced into the vessel in accordance with the spiral form, the quantity of material being regulated on the basis of the changing length of the turns of the spiral, with the quantity per unit of time, that is the mass flow, being adapted. Fines are understood as meaning feedstock of small particle sizes that are separated, usually by screening, for process engineering reasons. In the case of ores, particle sizes of up to 8 mm and, in the case of coke, particle sizes of up to 24 mm are considered to be fines.

According to a suitable refinement of the method according to the invention, the charging from the feeding device is performed batchwise. In this case, the charging is performed in discrete quantities, that is not constantly. After the charging of one discrete quantity, the charging of another discrete quantity is performed in the next cycle. It is advantageous in this case that discrete quantities of material can be alternately introduced and no complex valve devices are necessary to interrupt the material flow. Furthermore, it is consequently possible to charge pre-weighed quantities or mixtures.

According to a possible refinement of the method according to the invention, when charging fines, they are always introduced into the feeding device before the other feedstock. Before the loading of the feedstock or the fines into the vessel, these materials are first introduced into the feeding device. The fact that the fines are introduced first means that the charging of the fines into the vessel also always takes place first before the other feedstock. On account of the spiral charging, the fines are therefore introduced in the marginal regions and the feedstock is introduced in the turns of the spiral lying more on the inside. For the case where no fines are to be introduced, the charging of the feedstock is performed over the entire spiral, that is to say also in the marginal regions.

In accordance with a special refinement of the method according to the invention, the proportion by weight of fines is 2% to 20%, in particular 8% to 12%, of the total charged quantity. The proportion of fines may be chosen in accordance with the adaptation of the method, it being possible in particular to allow for the characteristics of the method being operated in the metallurgical vessel and the special conditions in the vessel.

A preferred refinement of the method according to the invention provides that the fines are charged spirally and predominantly onto the marginal region of the vessel, the radial end point of the spiral region onto which the fines have been charged from a feeding device forming the radial starting point for a subsequent charging of fines, in particular from a further feeding device, so that the fines are distributed uniformly over the marginal region. The controlled charging makes positionally accurate loading of the vessel possible. For extractive metallurgical processes, such as for example in a blast furnace, the gas distribution of the material introduced is important, since this also influences the process temperature or the temperature distribution. On account of the different gas permeability of fines, it is necessary to charge these materials specifically and uniformly in the marginal regions. When charging the fines, the loading takes place in the marginal region in accordance with the spiral form. When the fines in the feeding device have been used up, the feedstock that is likewise located in the feeding device follows. In a subsequent charging cycle, the fines that are then charged are introduced on a spiral, the starting point for the fines that are then charged following on with respect to their circumferential position directly from the previously charged fines. In this respect it is decisive that uniform charging takes place in the circumferential direction, the individual fractions of fine material not having to be in the same vertical position.

According to an advantageous refinement of the method according to the invention, the charging of the feedstock in the spiral takes place over 6 to 14, in particular 9 to 11, turns. The choice of the turns allows corresponding adaptation to the dimensions of the metallurgical vessel. In principle, the number of turns can also be increased if need be, if a special poured charge is required.

According to an advantageous refinement of the method according to the invention, the charging of the fines takes place in the two outer turns, in particular only in the outermost turn, of the spiral. It has proven to be advantageous to charge fines only in the outermost regions, since reduced gas permeability here means that the temperature distribution is not adversely influenced. On account of the charging only in the outermost turns, a high degree of reproducibility of the charging is achieved, and consequently very uniform distribution of the fines.

According to a particular refinement of the method according to the invention, the inclination of the conveying means is set as a function of the rotational speed, and with allowance for the given weight of feedstock, and optionally fines, in the feeding device, to produce a predefined distribution in the vessel. On account of the constant monitoring of the weight, and consequently also the weight of material already charged, the position in which the material is charged can be monitored by way of the rotational speed. Consequently, the charging of subsequent material can be adapted in accordance with this information, so that the quantity in specific positions can be set. This control allows the setting of a predefined charge.

An advantageous refinement of the method according to the invention provides that the inclination and the rotational speed of the conveying means respectively take place in a regulated manner by means of frequency converters. This refinement allows continuous and independent regulation for both movements, so that the method according to the invention can be put into practice.

A special refinement of the method according to the invention provides that the supply to the conveying means takes place alternately from different feeding devices, at least two feeding devices being provided. Consequently, the supply to the conveying means for loading the metallurgical vessel can take place alternately from two feeding devices, it being possible for these to be respectively supplied with feedstock or with fine material in advance. The arrangement of two or more feeding devices makes it possible to set the feedstock and the fines individually, in order in this way to allow more flexible charging.

According to an advantageous refinement of the method according to the invention, the feeding mechanism comprises at least one container for storing the feedstock, and optionally fines. The feedstock or the fines can be introduced into the container in advance, so that the entire container content can then be charged.

In accordance with a special refinement of the method according to the invention, the inclination and the rotational speed of the conveying means are controlled in such a way that the fines are charged substantially over a complete turn of the spiral. Very uniform distribution of the fines is achieved by this measure. The fines are thereby charged only onto the marginal regions of the metallurgical vessel, so that in this way it is even possible for greater quantitative proportions of fines to be processed without any disadvantages.

According to a further special refinement of the method according to the invention, the inclination and the rotational speed of the conveying means are controlled with allowance for instances of natural slippage in the radial direction on the inclined surface areas of the charged material. To ensure uniform gas distribution of the charged material in the metallurgical vessel, it is necessary to adapt the distribution of material on the vessel correspondingly, a target temperature profile being set. In this case, it may be necessary to charge non-uniformly over the cross section of the vessel, setting a poured charge with a surface that is not level but has slopes. When charging onto this charge, slippages occur on the inclined surface areas, so that the charged material changes its position of its own accord. On the basis of the known pouring plan, it is possible also to allow for such independent slippages when charging, and consequently set the desired poured charge even more accurately.

In accordance with a special refinement of the method according to the invention, the fines comprise a mixture of fines of coke and ore. Fines occur during the processing of ores, but also of coke. At present, these fines are often reprocessed, it being possible for this to take place for example in a sintering plant. However, this reprocessing is very complex and cost-intensive. According to the invention, therefore, fines, which are usually obtained by screening, are mixed and then used together with, for example, ores or coke. If need be, the fines may be mixed.

In accordance with a preferred refinement of the method according to the invention, the mixture has a proportion of coke of 5% to 40%, in particular 15% to 30%. This specific mixture takes account of the fact that the fines of ore have to be supplied by means of coke as a reducing agent. The proportions given above have proven in tests to be advantageous.

According to a possible refinement of the method according to the invention, coke and ore are charged alternately, optionally together with the fines and/or additives. It has proven to be advantageous not to introduce the materials comprising coke and ore, or optionally fines and/or additives, into the metallurgical vessel as mixtures but in a layered manner, with charging correspondingly being performed alternately. By this type of charging, allowance for the particular metallurgical conditions can be made even more specifically and an advantageous metallurgical process can be ensured.

The device according to the invention provides that at least one conveying means and at least one feeding device for supplying to the conveying means are provided, the conveying means having an outlet opening which can be guided along an inwardly directed spiral during the charging into a metallurgical vessel, to set a predefined coverage in the vessel. The guidance along a spiral offers the advantage of a uniform and very flexibly adaptable charge. This guidance allows deviations from a set poured charge to be largely avoided, and consequently a metallurgical process in the vessel to be optimized. The conveying means is mounted such that it can be rotated steplessly about one axis and at the same time can be set with respect to its inclination about a further axis. This refinement provides a very simple and robust device, allowing very strict compliance with specifications regarding the distribution of the charged material in the vessel. In particular, the sometimes very onerous ambient conditions in metallurgical plants, such as dust pollution and elevated temperatures, can be accommodated by rotatable mounting of the conveying means.

A preferred refinement of the device according to the invention provides that a frequency converter is respectively provided for regulating the inclination and the rotational speed of the conveying means. These frequency converters, which can be regulated independently of each other, ensure the greatest possible flexibility. In addition, simultaneous and completely continuous regulation is made possible by these frequency converters.

According to a possible refinement of the device according to the invention, the feeding device has a weighing mechanism, for continuously monitoring the feedstock, and optionally fines, during the charging. By the constant monitoring of the weight, and consequently the quantity, of material already charged, the position of the charged material is always known and ascertainable. In particular, this allows precise charges to be achieved, but also for example fines to be introduced in a positionally accurate manner, and consequently uniform charging of the fines over the circumference to be achieved.

The invention is described in detail on the basis of the following figures, by way of example and without implying any restriction.

DESCRIPTION OF A PREFERRED EMBODIMENT

Figure 1:
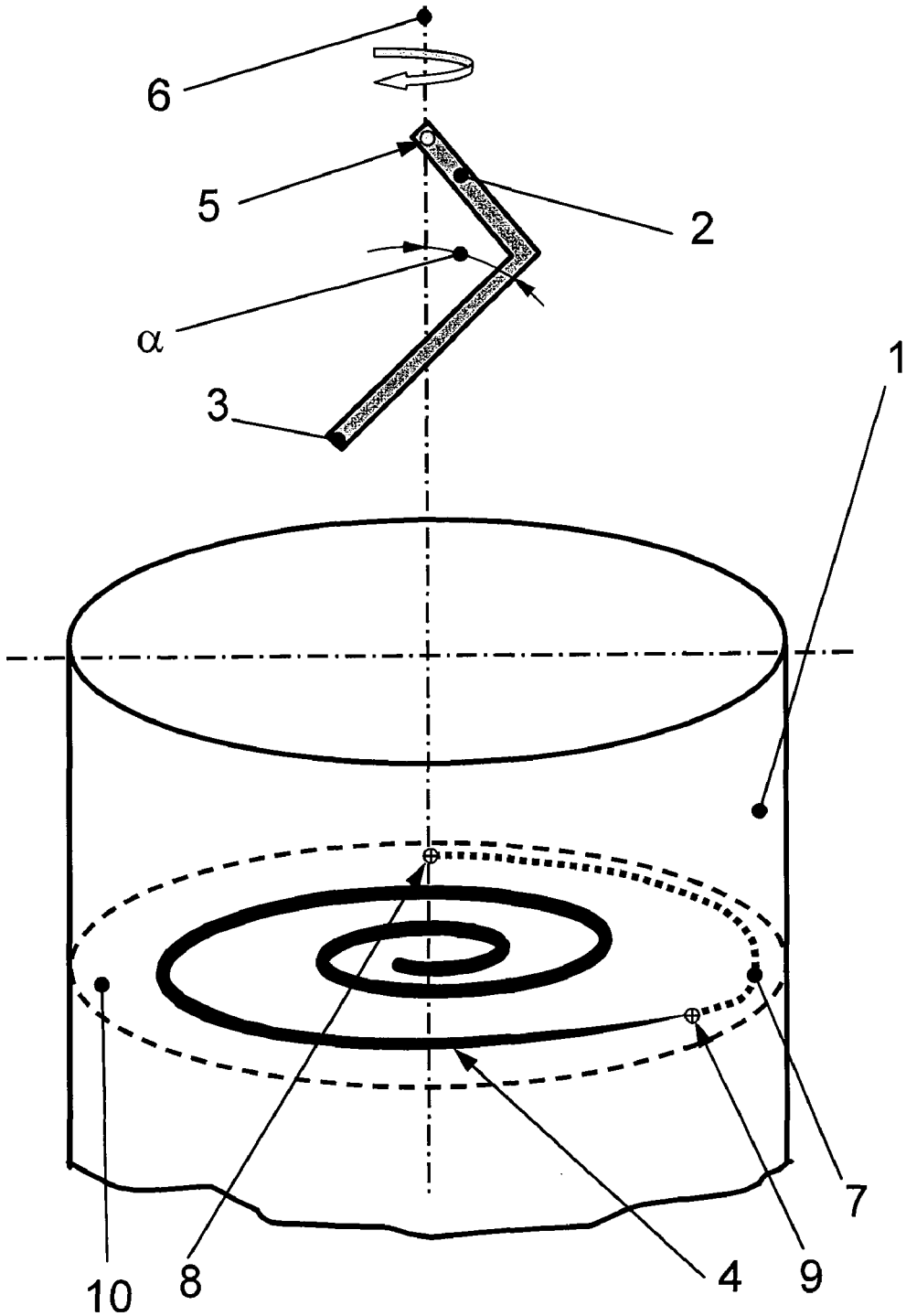
FIG. 1 shows a schematic representation of the charging according to the invention into a metallurgical vessel

In FIG. 1 the charging according to the invention is schematically represented. Charging is performed into the metallurgical vessel 1 from above, the upper termination of the vessel not being represented. A conveying means 2 is provided for the charging. In a special refinement, this conveying means is pivotably mounted about an axis 5, allowing the angle of inclination $\alpha$ of the conveying means 2 to be changed. At the same time as the adjustment about the axis 5, the conveying means 2 can be turned about the vertical axis 6. By these movements, the outlet opening 3 of the conveying means 2 describes a spiral form. The inclination of the conveying means is in this case changed in such a way that a spiral 4 directed from the outside inward is described. Consequently, the material charged by means of the conveying means 2 is also introduced into the vessel on a surface area in a spiral form and creates a corresponding poured charge 10.

When charging fines, they are always introduced into the vessel before the feedstock to be charged. The part 7 of the spiral that is thereby impinged, from the starting point 8 to the end point 9, can be precisely followed by the controlled load. On account of the constant measurement of the weight of the feeding device, which is provided for supplying to the conveying means, the quantity already charged can always be monitored at the same time. Consequently, the end point 9 of the spiral onto which the fines have been charged is known and can be used in an immediately subsequent or later charging cycle as the starting point for the next load of fines. In this way, the fines can be distributed uniformly over the circumference and in the vicinity of the edge of the vessel. However, the fines are preferably charged in such a way that they are distributed precisely over one full turn of the spiral.

Usually, the entire quantity of fines and feedstock is introduced into the feeding device and then charged by means of the conveying means 2. A charging cycle than involves the entire quantity of material that is located in the feeding device. Once the fines have been charged, the feedstock is distributed over the remaining turns of the spiral 4, this taking place in accordance with a predefined pouring plan. The rotational speed of the conveying means 2, the inclination a and the quantity supplied per unit of time from the feeding device can be adapted to the setting of a desired poured charge. It has been found to be advantageous to provide at least two feeding devices, so that different materials can also be introduced alternately and a poured charge built up layer by layer is made possible.

Figure 2:
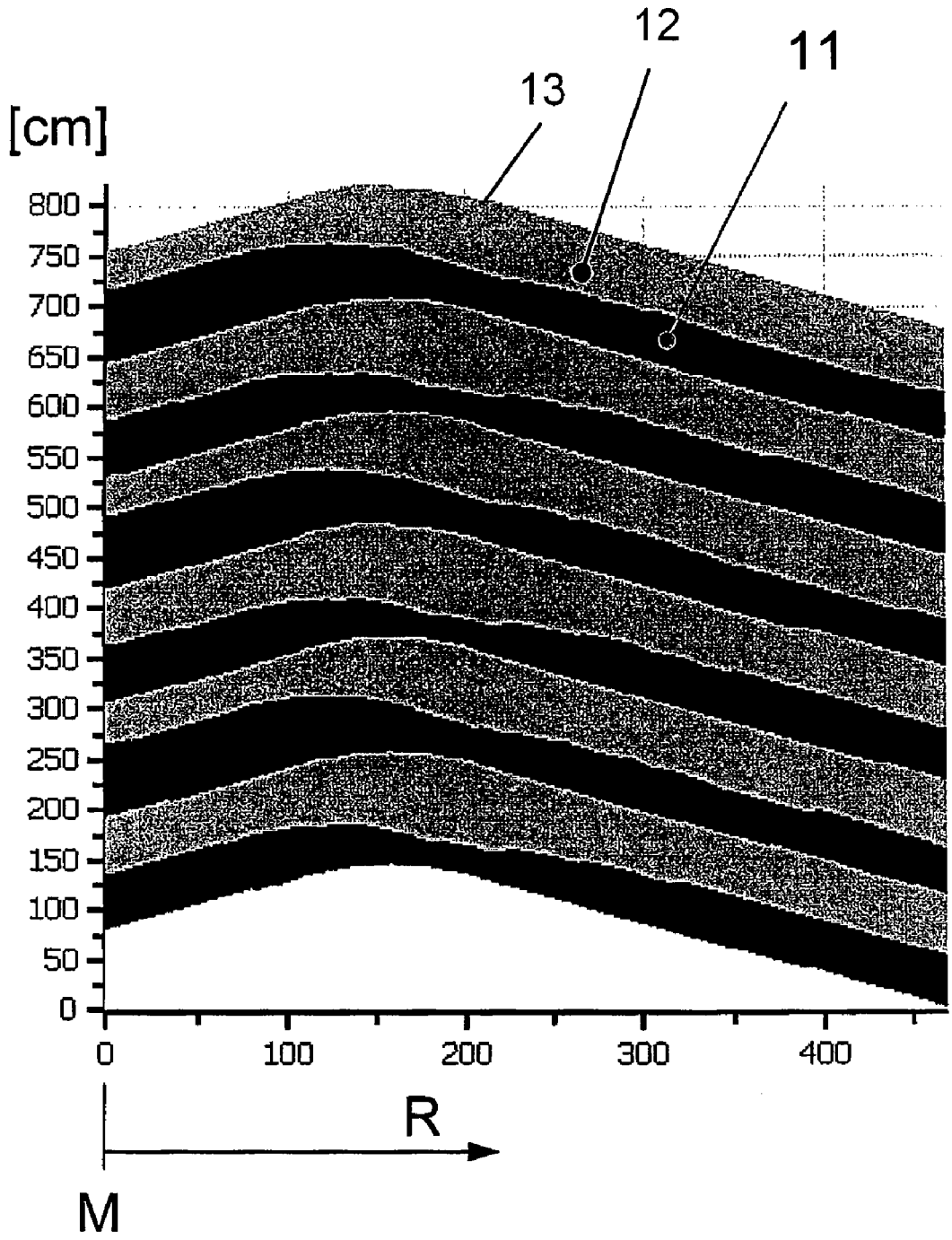
FIG. 2 shows a schematic representation of a poured charge that has been set by the method according to the invention

In FIG. 2, a poured charge in a metallurgical vessel is represented by way of example. The feedstock is in this case introduced layer by layer. The representation with an x axis which shows the radius R of the metallurgical vessel at a distance from the center axis M and a y axis which corresponds to the thickness of the poured charge, given in centimeters, shows that two different feedstocks 11 and 12 have been charged. On account of the gas distribution of the feedstock, poured charges that are not usually level but provided with humps are created. This consequently produces a surface 13 that is inclined.

Figure 3:
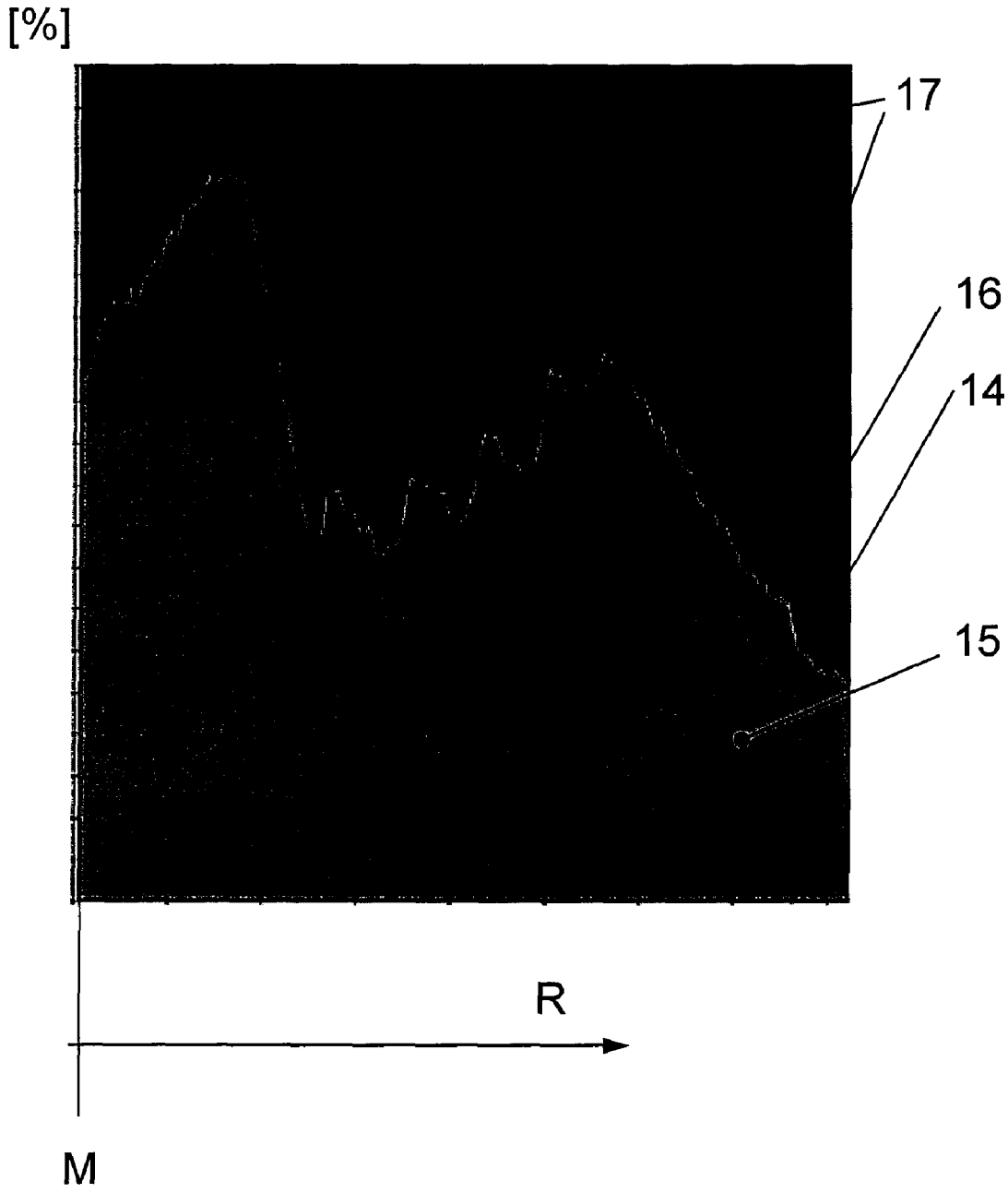
FIG. 3 shows a schematic representation of a poured charge that has been set by the method according to the invention.

FIG. 3 shows one possible poured charge in a representation which shows the quantitative proportions of the charged materials (y axis) over the distance R from the center axis M of the metallurgical vessel (x axis). Near the edge, the fines 14 can be seen, charged between coke 15 and ore 16 or further additives 17. The representation is given by way of example; the actual poured charge is set in accordance with a set temperature distribution.

Figure 4:
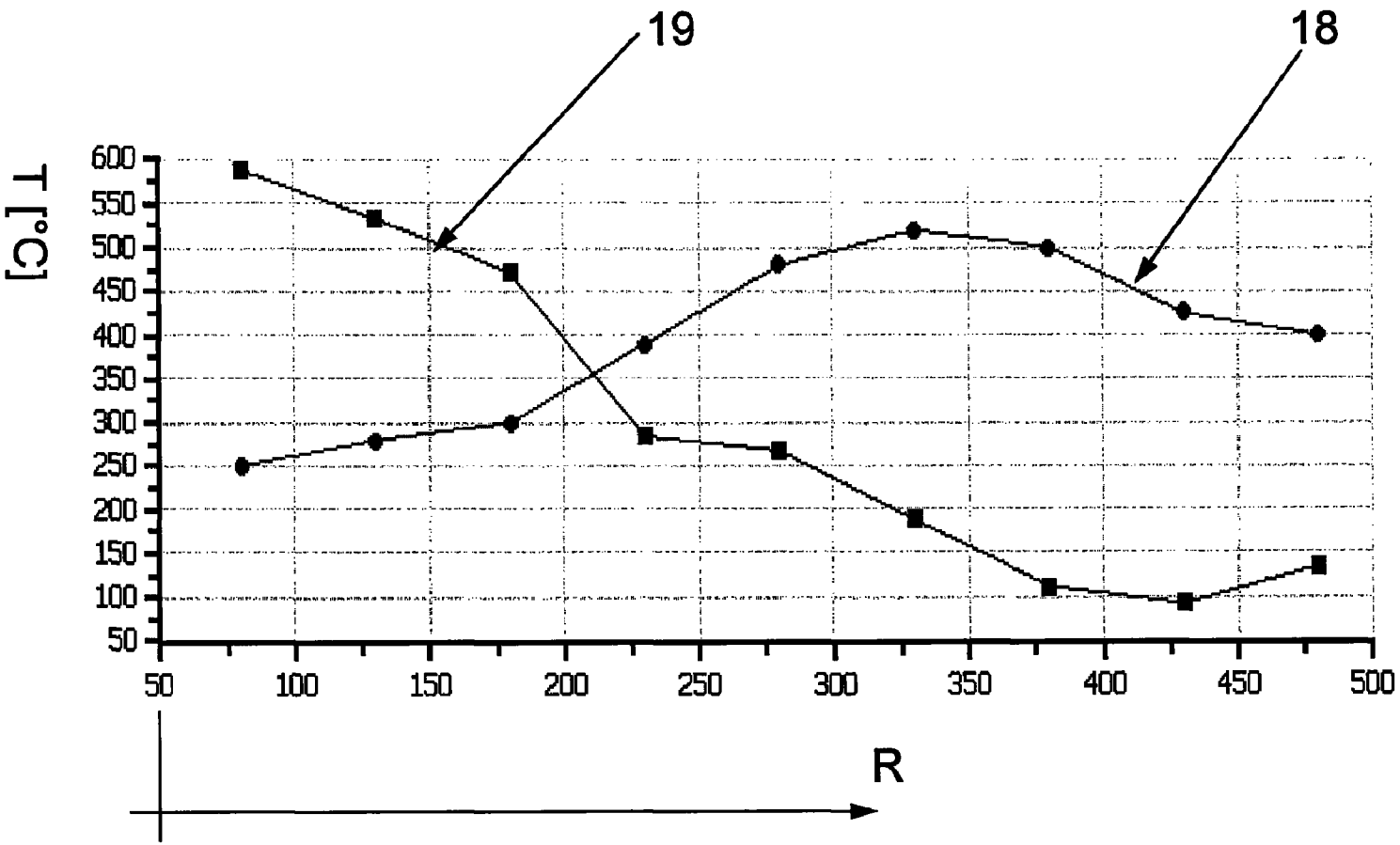
FIG. 4 is a graph of a representative temperature distribution and an actual temperature distribution in a vessel for the invention.

FIG. 4 shows by way of example a temperature distribution 18 in a metallurgical vessel, such as for example in a blast furnace, and an actual temperature distribution 19. The distance from the center axis of the metallurgical vessel is represented on the x axis; the y axis represents the temperatures. To minimize such deviations, the charging and the pouring are used to specifically influence and change the temperature distribution by way of changed gas distribution characteristics.

The invention claimed is:

1. A method for charging feedstock, for processing in a metallurgical vessel, wherein the method is performed with apparatus comprising a charging mechanism, which includes a conveying device, and at least one feeding device for supplying feedstock to the charging mechanism, the conveying device having an outlet opening, the method comprising:

(a) storing a charge of feedstock, including fines, into the at least one feeding device;

(b) charging at least a portion of the charge of feedstock from one of the at least one feeding device into the vessel through the outlet opening;

the outlet opening being guided along an inwardly directed spiral during the charging into the vessel, by controlling the conveying device to rotate steplessly about a first axis while the outlet opening is at the same time inclined about a further axis, wherein the inclination of the conveying device is set as a function of the rotational speed around the first axis, and the inclination of the conveying device further being set with allowance for a given weight in the feeding device of feedstock so as to produce a predefined distribution in the vessel, wherein the fines are first charged spirally and predominantly onto a marginal region of the vessel, and then the remainder of the feedstock in the one feeding device is charged spirally onto the vessel starting at an end point of the spiral region onto which the fines have been charged, a circumferential position of the end point of the spiral region onto which the fines have been charged from the one feeding device being a circumferential position of a starting point for a charging of fines in a subsequent spiral charging cycle of feedstock from another feeding device in order to distribute the fines uniformly over the marginal region; and (c) returning to step (b) if there is another feeding device with a charge of feedstock in it and to step (a) if there is more feedstock to be stored into the at least one feeding device.

2. The charging method as claimed in claim 1, wherein the feedstock comprises coke or ore.

3. The charging method as claimed in claim 2, wherein coke and ore are charged alternately, together with the fines.

4. The charging method as claimed in claim 1, wherein the metallurgical vessel is a blast furnace.

5. The charging method as claimed in claim 1, further comprising measuring an actual temperature distribution of the solids in the vessel;

controlling the charging mechanism and the charging in accordance with a predefined pouring plan, wherein the pouring plan is set for controlling gas distribution characteristics in the burden on the basis of the measured actual temperature distribution and a set temperature distribution of the solids in the vessel.

6. The charging method as claimed in claim 1, wherein supplying of the feedstock, including fines, from the feeding device includes regulating the quantities thereof.

7. The charging method as claimed in claim 1, wherein the charging from the feeding device is performed discontinuously.

8. The charging method as claimed in claim 1, wherein the fines are introduced into the feeding device before other feedstock.

9. The charging method as claimed in claim 1, wherein the proportion by weight of fines is 2% to 20%, of the total charged quantity.

10. The charging method as claimed in claim 1, wherein the charging of the feedstock in the spiral takes place over 6 to 14 turns of the spiral.

11. The charging method as claimed in claim 1, wherein the charging of the fines takes place in two outer most turns of the spiral.

12. The charging method as claimed in claim 1, wherein the inclination and the rotational speed of the conveying device respectively are regulated under control of frequency converters.

13. The charging method as claimed in claim 1, wherein supply to the conveying device takes place alternately from at least two different feeding devices.

14. The charging method as claimed in claim 1, wherein the inclination and the rotational speed of the conveying device are controlled such that the fines are charged substantially over a complete turn of the spiral.

15. The charging method as claimed in claim 1, wherein the inclination and the rotational speed of the conveying device are controlled with allowance for instances of natural slippage in the radial direction on inclined surface areas of the charged material.

16. The charging method as claimed in claim 1, wherein the fines comprise a mixture of fines of coke and ore.

17. The charging method as claimed in claim 16, wherein the mixture has a proportion of coke of 5% to 40%.

18. The charging method as claimed in claim 16, wherein the fines mixture has a proportion of coke of 15% to 30%.

19. The charging method as claimed in claim 1, wherein the proportion by weight of fines is 8% to 12% of the total charged quantity.

20. The charging method as claimed in claim 1, wherein the charging of the feedstock in the spiral takes place over 9 to 11 turns of the spiral.

21. The charging method as claimed in claim 1, wherein the charging of the fines takes place in an outermost turn of the spiral.

22. A device for charging feedstock, of coke or ore, and optionally of separated fines of feedstock, for processing in a metallurgical vessel to produce metal, the device comprising:

at least one conveying device, at least one feeding device for supplying feedstock to the conveying device, wherein the conveying device includes an outlet opening which is operable to be guided along an inwardly directed spiral during the charging of feedstock into the vessel in order to set a predefined coverage in the vessel, the conveying device being mounted and configured to be rotated steplessly and about a first axis and to be swung at the same time about a different second axis, the swinging of the conveying device at the same time about the different second axis causing a variation of an inclination of the conveying device about the first axis;

a frequency converter operable for regulating the inclination and the rotational speed of the conveying device, the inclination being regulated as a function of the rotational speed; and the feeding device having a weighing mechanism for monitoring the quantity of material already charged.

* * * * *